United States Patent [19]

Kondur, Jr.

[11] 4,242,006

[45] Dec. 30, 1980

[54] ADJUSTABLE MEDIA ADVANCEMENT MECHANISM

[75] Inventor: Nicholas Kondur, Jr., Riverton, Wyo.

[73] Assignee: C. Itoh Electronics, Inc., Los Angeles, Calif.

[21] Appl. No.: 912,089

[22] Filed: Jun. 2, 1978

[51] Int. Cl.[3] ..... B41J 19/76

[52] U.S. Cl. ..... 400/568; 400/575.2; 400/616.1; 400/619

[58] Field of Search ..... 400/124, 322, 568, 572, 400/573, 573.1, 575.2, 555, 616, 616.1, 616.2, 616.3, 619; 101/93.05, 93.29; 226/74, 75, 76, 77, 78, 79, 80, 81, 82, 83, 84, 85, 86, 87

[56] References Cited

U.S. PATENT DOCUMENTS

| | | | |
|---|---|---|---|
| 1,481,110 | 1/1924 | Pond | 400/568 X |
| 2,056,393 | 10/1936 | Didzuns | 400/568 |
| 2,456,734 | 12/1948 | Ritzert | 400/616.2 X |
| 3,414,106 | 12/1968 | Moran et al. | 400/616.1 X |
| 3,730,082 | 5/1973 | Perry | 400/616.1 X |
| 3,986,594 | 10/1976 | Kondur, Jr. | 400/322 X |
| 4,004,671 | 1/1977 | Kondur, Jr. | 101/93.05 X |
| 4,062,436 | 12/1977 | Kondur, Jr. | 400/124 |
| 4,070,963 | 1/1978 | Weaver | 101/93.29 |

FOREIGN PATENT DOCUMENTS

| | | | |
|---|---|---|---|
| 859537 | 1/1961 | United Kingdom | 400/575.2 |

*Primary Examiner*—Ernest T. Wright, Jr.
*Attorney, Agent, or Firm*—W. Edward Johansen

[57] ABSTRACT

The present invention is an improved media advancement mechanism for use in combination with a printer that includes a frame, a print head mechanically coupled to the frame and a platen mechanically coupled to the frame so that a print media may pass between it and the print head. The printer also includes a pair of sprockets which are adapted to support the print media and which are mechanically coupled to the frame by a sprocket shaft. The improved media advancement mechanism includes a ratchet wheel which is mechanically coupled to the sprocket shaft in order to provide rotational motion thereto in response to an electrical signal from the printer thereby moving the print media incrementally. The improved media advancement mechanism also includes an adjustment plate pivotally coupled to a sidewall of the frame and a restraining device for restraining the adjustment plate from its pivotal motion. The improved media advancement mechanism further includes a solenoid with an armature which receives an electrical signal from the printer and which is mechanically coupled to and disposed on the surface of the adjustment plate, a pawl which is mechanically coupled to the armature of the solenoid and which is disposed so that it can mechanically engage the teeth of the ratchet wheel in order to impart rotational motion thereto and a spring which mechanically couples the pawl to the adjustment plate.

2 Claims, 5 Drawing Figures

Fig. 1.
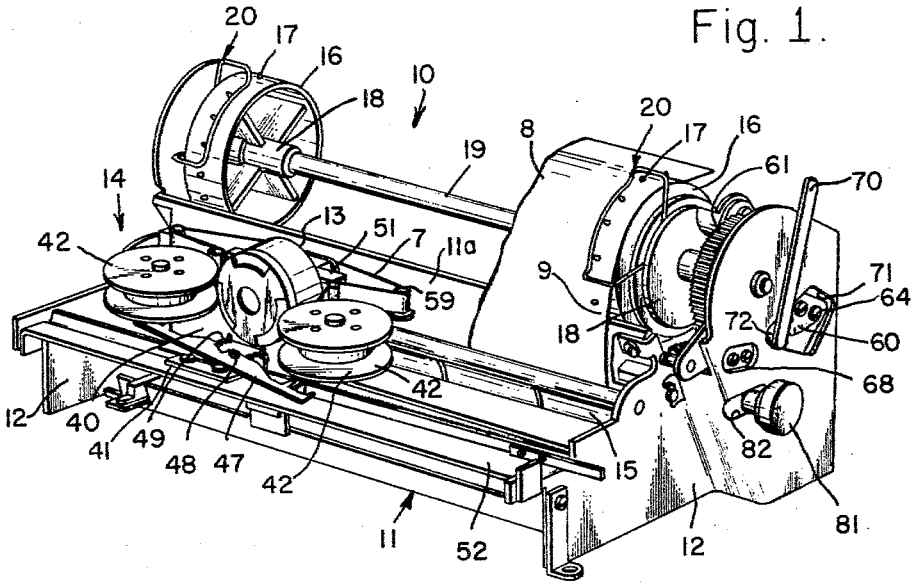
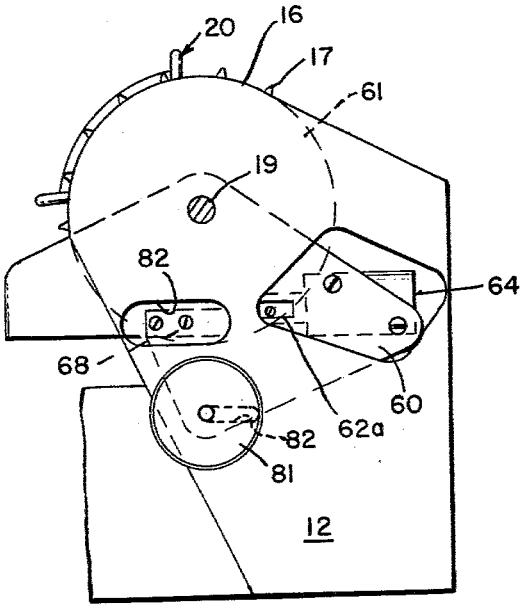
Fig. 2.
Fig. 3.
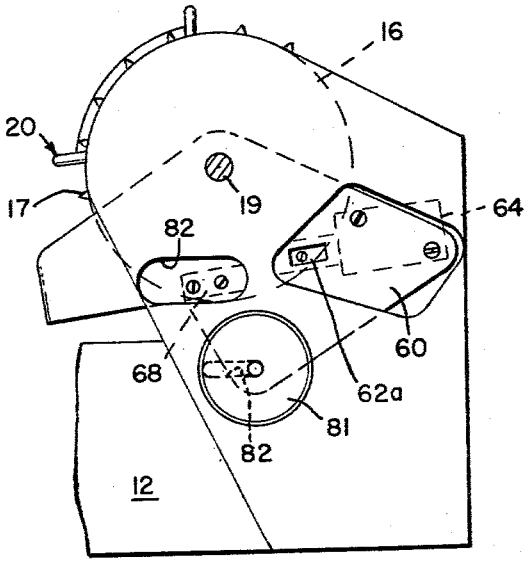

ADJUSTABLE MEDIA ADVANCEMENT MECHANISM

BACKGROUND OF THE INVENTION

1. Field of the Invention

The present invention relates to a media advancement mechanism of printers and more particularly to an advancement mechanism which provides a fine adjustment of the media in order to line up information on a preprinted form.

2. Description of the Prior Art

U.S. Pat. No. 3,986,594, entitled Serial Impact Calculator Printer, issued to Nicholas Kondur, Jr. on Oct. 19, 1976, teaches a serial impact printer of the type utilizing a dot matrix print head that is specifically adaptable for use as a calculator or adding machine and is characterized by utilizing a common drive source to advance the print head across the paper, advance the paper between printing operations, and selectively advance the inked ribbon between the ribbon supply spool and takeup spool. An improved paper-advancing apparatus has been devised which operates in close correlation with the print head drive member to provide a relatively high speed, simplified and inexpensive printer unit. The ribbon supply spools are so constructed and arranged as to be interchangeable and to permit direct drive through a spool-engaging member on the print head whereby to advance the inked ribbon in direct response to print head travel.

Paper-advancing rolls, including a platen and pressure roll are arranged in closely spaced, parallel relation to the cylindrical drive member for the print head, one of the rolls being incrementally driven by a drive pawl eccentrically mounted on the print head drive whereby to index the recording medium at the end of each printing cycle of the print head. The drive pawl selectively interengages with a ratchet on one of the paper-advancing rolls to overcome a detent which releasably engages one of the paper-advancing rolls to station the recording medium securely in position during the printing operation. In turn, the detent as well as the paper-advancing rolls are manually releasable to permit manual positioning or adjustment of the recording medium. The recording paper advances between the paperadvancing rolls along a resilient guide path which is so arranged as to accurately guide the paper between the rolls and to firmly support it in an upright position during the printing operation.

The above described apparatus for advancing the media in the printer is inadequate because the media can only be advanced in steps that correspond to each tooth of the ratchet wheel. Other than this one problem this apparatus is a good and inexpensive mechanism for advancing the media.

SUMMARY OF THE INVENTION

In view of the foregoing factors and conditions characteristic of the prior art it is a primary object of the present invention to provide a continuous advancement mechanism for the media advancement mechanism of the prior art that allows a user of the printer to adjust a preprinted form so that it aligns itself with the print line of the printer.

It is another object of the present invention to provide a continuous adjustment of the media advancement mechanism of the prior art that does not interfere with the normal operation of the incrementing device thereof.

It is still another object of the present invention to eliminate the need for other disengaging devices which are complicated in order to perform this same adjustment function.

In accordance with an embodiment of the present invention, an improved media advancement mechanism for use in combination with a printer that includes a frame, a point head mechanically coupled to the frame and a platen mechanically coupled to the frame so that a print media may pass between it and the print head is described. The printer also includes a pair of sprockets which are adapted to support the print media and which are mechanically coupled to the frame by a sprocket shaft. The improved media advancement mechanism includes a ratchet wheel which is mechanically coupled to the sprocket shaft in order to provide rotational motion thereto in response to an electrical signal from the printer thereby moving the print media incrementally. The improved media advancement mechanism also includes an adjustment plate pivotally coupled to a sidewall of the frame and a restraining device for restraining the adjustment plate from its pivotal motion. The improved media advancement mechanism further includes a solenoid with an armature which receives an electrical signal from the printer and which is mechanically coupled to and disposed on the surface of the adjustment plate, a pawl which is mechanically coupled to the armature of the solenoid and which is disposed so that it can mechanically engage the teeth of the ratchet wheel in order to impart rotational motion thereto and a spring which mechanically couples the pawl to the adjustment plate.

The features of the present invention which are believed to be novel are set forth with particularly in the appended claims.

Other objects and many of the attendant advantages will be more readily appreciated as the same becomes better understood by reference to the following detailed description and considered in connection with the accompanying drawing in which like reference symbols designate like parts throughout the figures.

DESCRIPTION OF THE DRAWING

FIG. 1 is a perspective drawing of a printer which includes a frame, a print head and a platen for use in combination with a media advancement mechanism that has been constructed in accordance with the principles of the present invention.

FIG. 2 is a side elevational view of the media advancement mechanism of the printer of FIG. 1 showing it in a first position.

FIG. 3 is a side elevational view of the media advancement mechanism of the printer of FIG. 1 showing it in a second position.

DESCRIPTION OF THE PREFERRED EMBODIMENT

Figure 4:
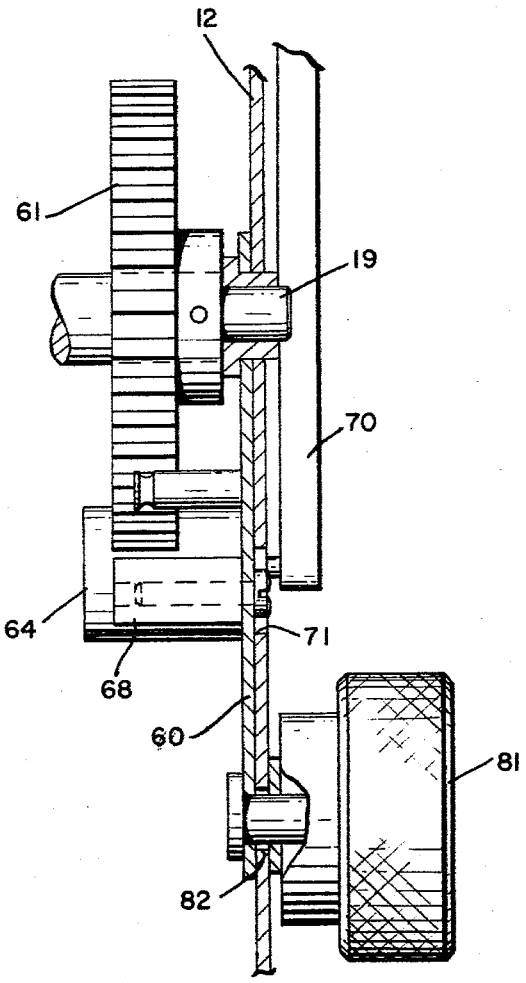
FIG. 4 is a cross-sectional view of the media advancement mechanism of FIG. 1.

In order to best understand the present invention it is first necessary to read the foregoing description of a printer which is to be used in combination with the present invention and also to refer to the figures in the accompanying drawing. Referring to FIG. 1 a printer 10 includes a frame 11 having a platen 11*a* and having a pair of side plates 12 and a print head 13 which is adapted to travel laterally across the front of the frame 11. The print head 13 is of a type which is generally taught in U.S. Pat. No. 4,004,671, entitled Wire Matrix Print Head, issued to Nicholas Kondur, Jr. on Jan. 25, 1977. Other U.S. Patents that teach similar print heads include: U.S. Pat. No. 4,070,963, U.S. Pat. No. 3,986,594 and U.S. Pat. No. 4,062,436. The printer 10 also includes an inking apparatus 14 which is mechanically coupled to the print head 13 in order to provide ink from an inked ribbon 7 for printing onto a print media 8 and a timing shaft 15 which is rotatably coupled to the frame 11 between the pair of side plates 12 and which is mechanically coupled to the print head 13 and the inking apparatus 14 in order to drive them in concert across the front of the frame 11. The print media 8 may be paper with sprocket holes 9 spaced a standardized distance apart along its borders. The printer 10 further inclues a pair of sprockets 16 each of which is a disc-shaped member having a plurality of pins 17 which are disposed on its cylindrical sidewall and are spaced apart the same distance as are the sprocket holes 9 of the paper 8 and also having a disc-shapped hub 18 and a sprocket shaft 19 which is rotatably coupled to the frame 11 between the pair of side plates 12 and which mechanically couples each of the sprockets 16 adjacent to one of the side plates 12 and a media guide 20 which is mechanically coupled to the disc-shaped hub 18 of the sprocket 16 so that the print media 8 is disposed between it and the cylindrical sidewall of the sprocket 16.

Still referring to FIG. 1 the inking apparatus 14 is similar to the one taught in U.S. Pat. No. 3,986,594, entitled Serial Impact Calculator Printer, issued to Nicholas Kondur, Jr. on Oct. 19, 1976. The inking apparatus 14 includes an inked ribbon advance and reverse mechanism 40 which is mounted on a plate member 41 and which travels in concert with the print head 13 across the front of the frame 11 of the printer 10. The inked ribbon advance and reverse mechanism 40 includes a pair of ribbon spools 42 which are disposed on the surface of the plate member 41 and which are rotatably coupled thereto so that the ribbon spools 42 can rotate bidirectionally in order to dispense an increment of inked ribbon 7. The inked ribbon advance and reverse mechanism 40 also includes a pawl 47 which is mechanically coupled to the plate member 41 by a pivot pin 48 that is in one of the groves 49 in the pawl 47. The inking apparatus 14 also includes an inked ribbon advancement mechanism 51 which continuously advances the increment of inked ribbon 7 between a pair of roller-pins 59.

Figure 5:
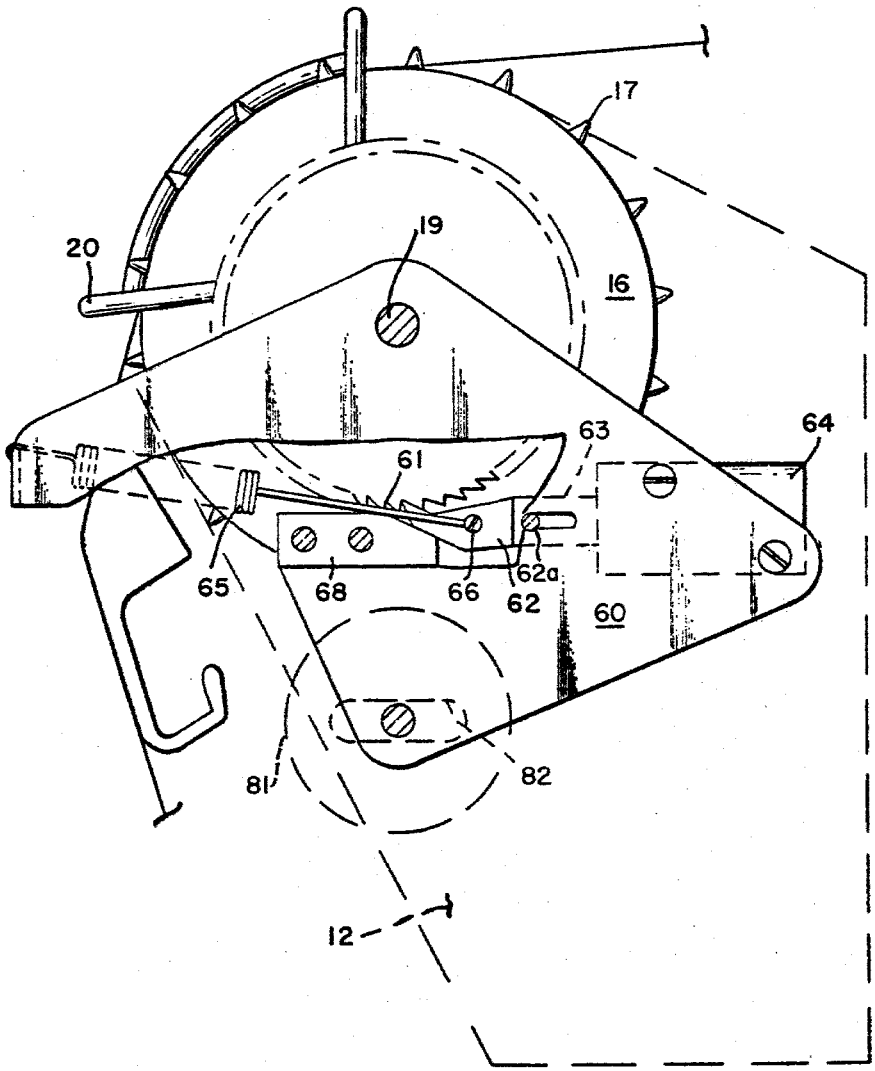
FIG. 5 is a partial side elevational view of the printer of FIG. 1 showing the media advancement mechanism in cooperation with the media guide.

Referring now to FIG. 2 in conjunction with FIG. 5 a media advancement mechanism for imparting rotational motion to the sprockets 16 mechanically coupled to the sprocket shaft 19 is similar to the mechanism taught in U.S. Pat. No. 4,070,963, entitled Impact Line Printer, issued to John Weaver on Jan. 31, 1978. The mechanism includes an adjustment plate 60 which is rotatively coupled to one of the side plates 12 and a ratchet wheel 61 which is mechanically coupled to the sprocket shaft 19, a pawl 62 which engages the ratchet wheel 61 and which is pivotally coupled by a pin 62*a* to the end of an armature 63 of a media feed solenoid 64 and a spring 65 which mechanically couples the adjustment plate 60 to the pawl 62 at a point 66 so located that the line of its force is slightly below the pawl's pivot axis about the pin 62*a* in order that a single spring 65 is sufficient to both advance the pawl 62 upon release of the armature 63 and apply a clockwise force upon the pawl 62 in order to maintain it in engagement with the ratchet wheel 61 and a pawl stop 68. Each time a pulse of current is supplied to the media feed solenoid 64, the ratchet wheel 61 causes the sprocket 16 and the print media 8 to advance a distance corresponding to the spacing of the teeth on the ratchet wheel 61 and the ratio of the diameter of the sprocket 16 and the ratchet wheel 61. The current pulses are supplied automatically as part of the printing cycle to the media feed solenoid 64.

The media advancement mechanism also has a manual advance which includes a lever 70 which is coupled to the armature 63 of the media feed solenoid 64 through a slot 71 in the side plate 12 which is adjacent to the adjustment plate 60. The lever 70 is mechanically coupled to the armature 63 of the media feed solenoid 64 by the pin 62*a* which is shown in FIG. 2.

Referring back to FIG. 1 the preprinted print media 8 is disengageably coupled to the sprockets 16 through the pins 17 which project through sprocket holes 9 in the preprinted print media 8. When the sprockets 16 rotate, the print media 8 follows the direction of the rotation of the sprockets 16 which moves the media 8 from its rest position. Furthermore, the extension of the continuous webbed print media 8 which passes between the print head 13 and the platen 11*a* of the printer 10 moves in an approximately vertical direction.

Referring now to FIG. 2 in conjunction with FIG. 1 the sprockets 16 and the ratchet wheel 61 are rigidly coupled to the sprocket shaft 19. The rotation of the ratchet wheel 61 produces the same angular rotation of the sprockets 16. The adjustment plate 60 on which the pawl 62 and the other components of the media advancement mechanism are disposed is pivotally coupled to the sprocket shaft 19. The improved media advancement mechanism includes a restraining device which restrains the pivotal motion of the adjustment plate 60 about the sprocket shaft 19. The restraining device includes a clamp nut 81 and a slot 82 in the side plate 12 which is disposed so that the unloosened clamp nut 81 which is coupled rigidly to the adjustment plate 60 and loosely to the side plate 12 within the slot 82, constrains the pivotal motion within a specified range of angular motion that is within the equivalent angular motion of one tooth of the ratchet wheel 61. The tightened clamp nut 81 restrains the pivotal motion when a particular setting has been achieved by the operator.

Referring now to FIG. 3 and FIG. 4 in conjunction with FIG. 2 it can be seen that the clamp nut 81 fixedly couples the side plate 12 to the adjustment plate 60 until it is loosened at which time the adjustment plate 60 pivots about the sprocket shaft 19 constrained only by the slot 82 in the side plate 12. The incrementing mechanism taught in U.S. Pat. No. 4,070,963 is not affected by this pivotal motion thereby eliminating the need for a complicated disengaging mechanism that is necessary in other printers.

Referring now to FIG. 5 in conjunction with FIG. 2 and FIG. 3 the adjustment plate 60 has the media feed solenoid 64, the spring 65 and the pawl stop 68 fixedly mounted thereon. The pawl 62 is mechanically coupled to the armature 63 of the media feed solenoid 64 and is also resiliently coupled to the teeth of the ratchet wheel 61 by the spring 65. The movement of the pawl 62 is stopped by the pawl stop 68. An electrical impulse activates the media feed solenoid 64 and causes the armature 63 to move rearward thereby disengaging the pawl 62 from a tooth of the ratchet wheel 61. The spring 65 pulls the rearwardly moved pawl 62 upward into the preceding tooth of the ratchet wheel 61 and forward so that the pawl 62 engages the preceding tooth of the ratchet wheel 61 thereby rotating the ratchet wheel 61 clockwise in order to incrementally advance the media. The improved media advancement mechanism not only includes the incrementing mechanism taught in U.S. Pat. No. 4,070,963, but it also includes a fine adjustment mechanism. The operation of the fine adjustment mechanism involves the adjustment plate 60 pivoting about the sprocket shaft 19 restrained only by the ends of the slot 82 in the side plate 12. The fine adjustment mechanism can advance the media 8 an infinitesimally small increment within the pivotal range of the adjustment plate 60.

The sprocket shaft 19 is disposed perpendicularly to the two side plates 12 and is freely rotatively coupled thereto. The sprockets 16 and the ratchet wheel 61 are fixedly coupled to the sprocket shaft 19. The pawl 62 of the media advancement mechanism limits the rotational movement of the ratchet wheel 61 and the sprockets 16, relative to the adjustment plate 60. The adjustment plate 60 pivots about the sprocket shaft 19 and has the same center of rotation as the ratchet wheel 61 has. The fine adjustment mechanism of the improved media advancement mechanism is provided by the adjustment plate 60, when the pawl 62 is engaged in a particular tooth of the ratchet wheel 61, moving pivotally about the sprocket shaft 19 so that the pawl 62 and the ratchet wheel 61 may be advanced in infinitesimally fine graduations.

From the foregoing it can be seen that an improved media advancement mechanism has been described. Accordingly, it is intended that the foregoing disclosure and showing made in the drawing shall be considered only as illustrations of the present invention. Furthermore it should be noted that the sketches are not drawn to scale and that distances of and between the figures are not to be considered significant. The invention will be set forth with particularity in the appended claims.

What is claimed is:

1. Adjusting mechanism for use in combination with a media advancement mechanism of a printer to adjust the line position on a print media wherein the media advancement mechanism of the printer includes:

a. a frame having a first sidewall and a second sidewall;

b. a print head which is mechanically coupled to the frame;

c. a platen which is separately coupled to the frame so that the print media may pass between the print head and the platen;

d. a shaft which is rotatively coupled between the first and second sidewalls of the frame;

e. supporting means for supporting the print media which are rotatively coupled to the shaft and the rotational axis of which is parallel to the platen;

f. a ratchet wheel which has teeth and which is axially aligned with and mechanically coupled to the supporting means so that the ratchet wheel provides rotational motion thereto in order to move the print media incrementally in response to an electrical signal from the printer;

g. a solenoid which has an armature, the solenoid being rigidly coupled to said adjusting mechanism;

h. a pawl mechanically coupled to the armature of the solenoid and disposed so that the pawl can mechanically engage one of the teeth of the ratchet wheel in order to impart rotational motion thereto; and i. a spring resiliently coupling the pawl to said adjusting mechanism, said adjusting mechanism comprising:

a. a plate member pivotally coupled to the shaft adjacent to the first sidewall of the frame wherein the solenoid is mounted on said plate member and the pawl is resiliently coupled to said plate member by the spring; and b. restraining means for restraining said plate member from its pivotal motion.

2. An adjusting mechanism according to claim 1 wherein said restraining means and said plate member operate in conjunction with each other and independently from the operation of the pawl and the ratchet wheel irrespective of whether or not the pawl and the teeth of the ratchet wheel are engaged.

* * * * *